US011286756B2

(12) United States Patent
Harrigan et al.

(10) Patent No.: US 11,286,756 B2
(45) Date of Patent: Mar. 29, 2022

(54) SLICKLINE SELECTIVE PERFORATION SYSTEM

(71) Applicant: Halliburton Energy Services, Inc., Houston, TX (US)

(72) Inventors: Edward Harrigan, Richmond, TX (US); Francis Michael Heaney, Tomball, TX (US); Wei Sun, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 90 days.

(21) Appl. No.: 16/489,421

(22) PCT Filed: Oct. 17, 2018

(86) PCT No.: PCT/US2018/056303
§ 371 (c)(1),
(2) Date: Aug. 28, 2019

(87) PCT Pub. No.: WO2020/081073
PCT Pub. Date: Apr. 23, 2020

(65) Prior Publication Data

US 2020/0378221 A1 Dec. 3, 2020

(51) Int. Cl.
*E21B 43/117* (2006.01)
*E21B 43/119* (2006.01)
*E21B 47/12* (2012.01)

(52) U.S. Cl.
CPC ..... *E21B 43/117* (2013.01); *E21B 43/119* (2013.01); *E21B 47/12* (2013.01)

(58) Field of Classification Search
CPC .... E21B 43/119; E21B 43/117; E21B 43/116; E21B 47/12
See application file for complete search history.

(56) References Cited

U.S. PATENT DOCUMENTS 7,565,927 B2 * 7/2009 Gerez ..... E21B 43/116 166/250.01
7,652,592 B2 * 1/2010 Le Briere ..... E21B 47/13 340/854.6

(Continued)

FOREIGN PATENT DOCUMENTS

WO WO-2009074884 A2 * 6/2009 ..... E21B 47/08
WO WO-2015188083 A1 * 12/2015 ..... E21B 47/13

OTHER PUBLICATIONS

Acquire, (n.d.) American Heritage® Dictionary of the English Language, Fifth Edition. (2011). Retrieved Jul. 13, 2021 from https://www.thefreedictionary.com/acquire, 2 pages (Year: 2011).*

(Continued)

*Primary Examiner* — Jennifer H Gay
(74) *Attorney, Agent, or Firm* — John Wustenberg; C. Tumey Law Group PLLC

(57) ABSTRACT

Systems and methods are provided for transmitting information to and from a downhole tool for detonation at a specified location. Perforating systems and methods may use a digital slickline unit and a telemetry module to autonomously operate within a wellbore. A well system may comprise: a downhole perforating system comprising: at least one perforating gun; a setting tool; and a control unit coupled to the at least one perforating gun and the setting tool in a tool string for conveyance downhole, wherein the control unit comprises a battery pack, electronics, at least one sensor, wherein the electronics are operable to send one or more actuation signals to the at least one perforating gun and the setting tool.

19 Claims, 3 Drawing Sheets

(56) References Cited

U.S. PATENT DOCUMENTS

| | | | | |
|---|---|---|---|---|
| 7,698,937 | B2 * | 4/2010 | Neidhardt | E21B 47/08 73/152.57 |
| 7,878,242 | B2 * | 2/2011 | Gray | E21B 47/09 166/250.13 |
| 8,157,022 | B2 * | 4/2012 | Bertoja | E21B 43/11857 175/4.54 |
| 8,496,065 | B2 * | 7/2013 | McCarter | E21B 43/14 166/382 |
| 8,540,021 | B2 * | 9/2013 | McCarter | E21B 43/14 166/250.01 |
| 8,547,246 | B2 | 10/2013 | Menezes et al. | |
| 9,284,819 | B2 * | 3/2016 | Tolman | E21B 43/116 |
| 9,903,192 | B2 * | 2/2018 | Entchev | E21B 43/263 |
| 10,151,181 | B2 * | 12/2018 | Lopez | E21B 23/065 |
| 10,731,430 | B2 * | 8/2020 | LaGrange | E21B 23/08 |
| 2006/0044155 | A1 * | 3/2006 | Le Briere | E21B 47/13 340/854.3 |
| 2007/0007016 | A1 * | 1/2007 | Sanderlin | E21B 47/00 166/381 |
| 2007/0125540 | A1 * | 6/2007 | Gerez | E21B 43/116 166/298 |
| 2008/0128133 | A1 * | 6/2008 | Turley | E21B 43/26 166/281 |
| 2009/0084535 | A1 * | 4/2009 | Bertoja | E21B 43/11857 166/55.2 |
| 2009/0101337 | A1 * | 4/2009 | Neidhardt | E21B 47/08 166/250.01 |
| 2009/0301723 | A1 * | 12/2009 | Gray | G01V 11/002 166/301 |
| 2013/0062055 | A1 * | 3/2013 | Tolman | E21B 43/119 166/250.01 |
| 2013/0168078 | A1 * | 7/2013 | McCarter | E21B 31/007 166/66.4 |
| 2013/0168083 | A1 * | 7/2013 | McCarter | E21B 23/00 166/250.01 |
| 2014/0131035 | A1 * | 5/2014 | Entchev | E21B 33/1204 166/255.1 |
| 2016/0299253 | A1 | 10/2016 | Zhang et al. | |
| 2019/0284889 | A1 * | 9/2019 | Lagrange | E21B 47/092 |
| 2019/0301258 | A1 * | 10/2019 | Li | E21B 47/09 |
| 2019/0309608 | A1 * | 10/2019 | Phelps | H01R 12/714 |
| 2020/0378221 | A1 * | 12/2020 | Harrigan | E21B 43/117 |

OTHER PUBLICATIONS

Request, (n.d.) American Heritage® Dictionary of the English Language, Fifth Edition. (2011). Retrieved Jul. 13, 2021 from https://www.thefreedictionary.com/request (Year: 2011).*

ISRWO International Search Report and Written Opinion for PCT/US2018/102184 dated Jul. 17, 2019.

* cited by examiner

SLICKLINE SELECTIVE PERFORATION SYSTEM

BACKGROUND

After drilling various sections of a subterranean wellbore that traverses a formation, a casing string may be positioned and cemented within the wellbore. This casing string may increase the integrity of the wellbore and may provide a path for producing fluids from the producing intervals to the surface. To produce fluids into the casing string, perforations may be made through the casing string, the cement, and a short distance into the formation. After perforating, fracturing may be performed to propagate and prop open fractures in the formation to increase flow of hydrocarbons from the reservoir.

These perforations may be created by detonating a series of shaped charges that may be disposed within the casing string and may be positioned adjacent to the formation. Specifically, one or more perforating guns may be loaded with shaped charges that may be connected with a detonator via a detonating cord. The perforating guns may then be attached to a tool string that may be lowered into the cased wellbore. Once the perforating guns are properly positioned in the wellbore such that the shaped charges are adjacent to the formation to be perforated, the shaped charges may be detonated, thereby creating the desired perforations.

Previous systems and methods may detonate without verification from the perforating guns. Typically, the perforating guns may be run downhole on a wireline and may be actuated from the surface. The perforating guns may not have been capable of relaying information from downhole to the surface to verify that detonation will occur in the desired location.

BRIEF DESCRIPTION OF THE DRAWINGS

These drawings illustrate certain aspects of some examples of the present disclosure, and should not be used to limit or define the disclosure.

DETAILED DESCRIPTION

This disclosure may generally relate to subterranean operations. More particularly, systems and methods may be provided for transmitting information to and/or from a downhole tool for detonation at a specified location. Perforating systems and methods may use a digital slickline unit and/or a telemetry module to autonomously operate within a wellbore. In examples, perforating guns may be selectively fired on command from the surface at different depths.

Figure 1:
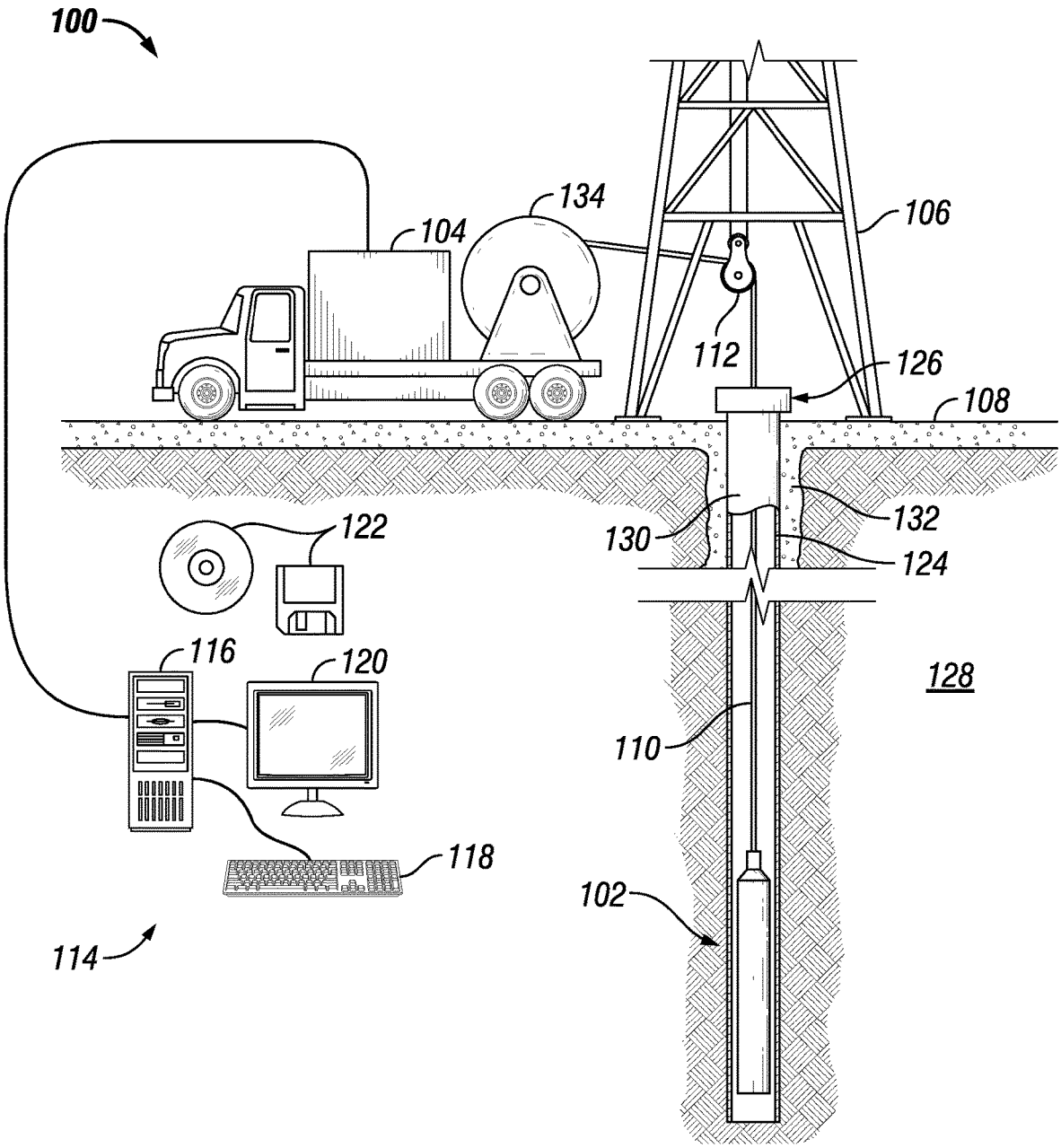
FIG. 1 illustrates an example of a downhole perforating system disposed in a wellbore.

FIG. 1 illustrates a cross-sectional view of a well system 100. As illustrated, well system 100 may comprise a downhole perforating system 102 attached to a vehicle 104. In examples, it should be noted that downhole perforating system 102 may not be attached to a vehicle 104. Downhole perforating system 102 may be supported by a rig 106 at surface 108. Downhole perforating system 102 may be tethered to vehicle 104 through a slickline 110. Slickline 110 may be disposed around one or more sheave wheels 112 to vehicle 104. The terms "slickline" also used herein refers to mechanical conveyance for running tools into a wellbore. A slickline is a single mechanical strand that can come in varying lengths, depending on the particular application. In contrast, "wirelines" typically have an insulated conductor through the center and a mechanical "armor" around the outside which serves as the electrical return path. As used herein, the term "slickline" is also intended to encompass digital slickline in which an insulator is added around the single mechanical strand, allowing an electrical circuit by returning current via the casing. In examples, the slickline 110 may be in the form of a digital slickline may enable an electric circuit between downhole perforating system 102 and surface 108. Slickline 110 may lower downhole perforating system 102 downhole to a desired depth.

Information from downhole perforating system 102 may be gathered and/or processed by an information handling system 114. For example, signals recorded by downhole perforating system 102 may be communicated to and then processed by information handling system 114. Alternatively, information may be stored in memory disposed within downhole perforating system 102 while operating downhole. Without limitation, the processing may be performed in real-time. Processing may alternatively occur downhole or may occur both downhole and at surface 108. In some examples, signals recorded by downhole perforating system 102 may be conducted to information handling system 114 by way of slickline 110. Information handling system 114 may process the signals, and the information contained therein may be displayed for an operator to observe and stored for future processing and reference. Information handling system 114 may also contain an apparatus for supplying control signals to downhole perforating system 102.

Information handling system 114 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, an information handling system 114 may be a processing unit 116, a network storage device, or any other suitable device and may vary in size, shape, performance, functionality, and price. Information handling system 114 may include random access memory (RAM), one or more processing resources such as a central processing unit (CPU) or hardware or software control logic, ROM, and/or other types of nonvolatile memory. Additional components of the information handling system 114 may include one or more disk drives, one or more network ports for communication with external devices as well as various input and output (I/O) devices, such as an input device 118 (e.g., keyboard, mouse, etc.) and a video display 120. Information handling system 114 may also include one or more buses operable to transmit communications between the various hardware components.

Alternatively, systems and methods of the present disclosure may be implemented, at least in part, with non-transitory computer-readable media 122. Non-transitory computer-readable media 122 may include any instrumentality or aggregation of instrumentalities that may retain data and/or instructions for a period of time. Non-transitory computer-readable media 122 may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

As illustrated, downhole perforating system 102 may be disposed in a wellbore 124 by way of slickline 110. Wellbore 124 may extend from a wellhead 126 into a subterranean formation 128 from surface 108. Generally, wellbore 124 may include horizontal, vertical, slanted, curved, and other types of wellbore geometries and orientations. Wellbore 124 may be cased or uncased. In examples, wellbore 124 may comprise a metallic material, such as tubular 130. By way of example, the tubular 130 may be a casing, liner, tubing, or other elongated steel tubular disposed in wellbore 124. As depicted, tubular 130 may be secured within wellbore 124 by cement 132. As illustrated, wellbore 124 may extend through subterranean formation 128. Wellbore 124 may extend generally vertically into subterranean formation 128. However, wellbore 124 may extend at an angle through subterranean formation 128, such as in horizontal and slanted wellbores. For example, although wellbore 124 is illustrated as a vertical or low inclination angle well, high inclination angle or horizontal placement of the well and equipment may be possible. It should further be noted that while wellbore 124 is generally depicted as a land-based operation, those skilled in the art may recognize that the principles described herein are equally applicable to subsea operations that employ floating or sea-based platforms and rigs, without departing from the scope of the disclosure.

In examples, rig 106 includes a load cell (not shown) which may determine the amount of pull on slickline 110 at surface 108 of wellbore 124. While not shown, a safety valve may control the hydraulic pressure that drives a drum 134 on vehicle 104 which may reel up and/or release slickline 110 which may move downhole perforating system 102 up and/or down wellbore 124. The safety valve may be adjusted to a pressure such that drum 134 may only impart a small amount of tension to slickline 110 over and above the tension necessary to retrieve Slickline 110 and/or downhole perforating system 102 from wellbore 124. The safety valve is typically set a few hundred pounds above the amount of desired safe pull on slickline 110 such that once that limit is exceeded; further pull on slickline 110 may be prevented.

When it is desired to perforate subterranean formation 128, downhole perforating system 102 may be lowered through, and/or pumped through a horizontal section of, tubular 130 until downhole perforating system 102 is properly positioned relative to subterranean formation 128. Upon detonation, components within downhole perforating system 102 may form jets that may create a spaced series of perforations extending outwardly through tubular 130, cement 132, and into subterranean formation 128, thereby allowing formation communication between subterranean formation 128 and wellbore 124.

In examples, downhole perforating system 102 may be operable to actuate when certain conditions are met. Downhole perforating system 102 may obtain measurements for a suitable well parameter. Without limitations, a suitable well parameter may be depth within wellbore 124, location of a casing collar, pressure, temperature, gamma radiation, acceleration of downhole perforating system 102, acoustics, formation resistivity, magnetic resonance of a formation, or acoustic measurements of the formation, and/or combinations thereof. Downhole perforating system 102 may transmit the acquired measurements to information handling system 114 via slickline 110 (e.g., in the case of a digital slickline) and/or through the use of a telemetry module (e.g., telemetry module 304 as shown on FIG. 3). Once information handling system 114 has received the measurements from downhole perforating system 102, information handling system 114 may transmit commands to downhole perforating system 102 to actuate. In alternate examples, downhole perforating system 102 may actuate autonomously in relation to information handling system 114 once the well parameters have been acquired.

Figure 2:
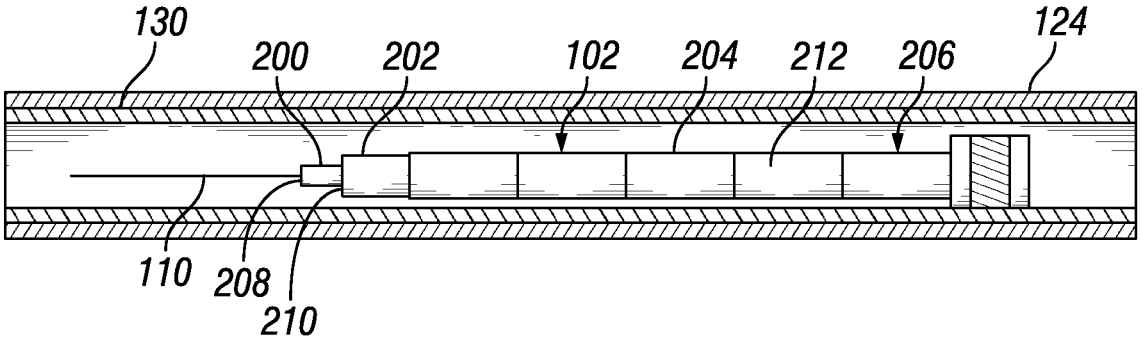
FIG. 2 illustrates a close-up view of the example downhole perforating system of FIG. 1 disposed in a wellbore

FIG. 2 illustrates an example of downhole perforating system 102. In examples, downhole perforating system 102 may perforate tubular 130 and collect measurements on well parameters. Downhole perforating system 102 may include a logging head 200, a control unit 202, a perforating gun 204, a setting tool 206, and a release tool 212.

Logging head 200 may be disposed at a proximal end of downhole perforating system 102. Logging head 200 may mechanically and/or electrically couple downhole perforating system 102 to slickline 110 at a first end 208 of logging head 200. Logging head 200 may couple downhole perforating system 102 to slickline 110 using any suitable mechanism including, but not limited, the use of suitable fasteners, threading, adhesives, welding and/or any combination thereof. Without limitation, suitable fasteners may include nuts and bolts, washers, screws, pins, sockets, rods and studs, hinges and/or any combination thereof. In some examples, logging head 200 may serve as a designated failure point if downhole perforating system 102 gets stuck in wellbore 124. In those examples, an operator may apply a tensional force along slickline to the point of logging head 200 experiencing a yielding stress. In examples, an operator may be defined as an individual, group of individuals, or an organization. Downhole perforating system 102 may be fished out in subsequent operations.

Figure 3:
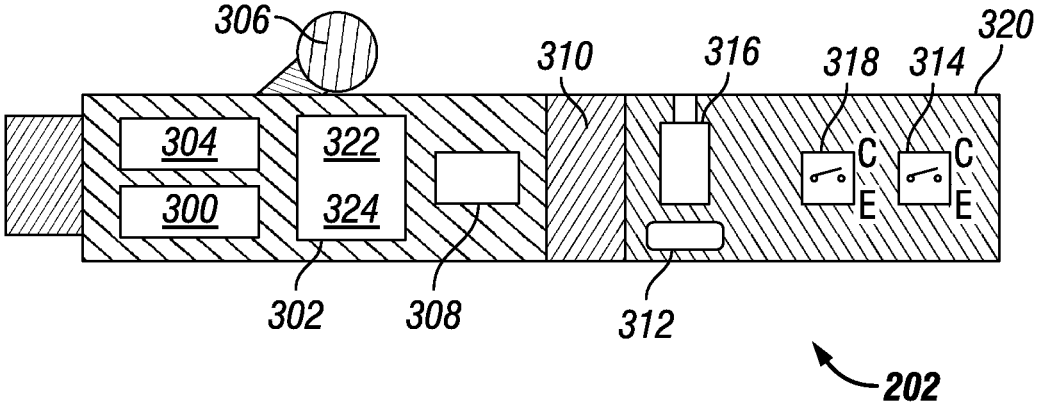
FIG. 3 illustrates an example of a control unit for use in a downhole perforating system.

As illustrated, control unit 202 may be disposed at a second end 210 of logging head 200. Control unit 202 may provide power and commands to downhole perforating system 102. Referring now to FIG. 3, control unit 202 may include any suitable sensor to measure a well parameter. Without limitations, control unit 202 may include a battery pack 300, electronics 302, a telemetry module 304, a trundle wheel 306, an accelerometer 308, a casing collar locator 310, a temperature gauge 312, a temperature switch 314, a pressure gauge 316, a pressure switch 318, and/or combinations thereof. Control unit 202 may also include a housing 320. Housing 320 may be any suitable size, height, and/or shape. In some examples, housing 320 may have a circular cross-section and be generally cylindrical in shape. In other examples, control unit 202 may comprise a load cell (not illustrated) that measures tension in slickline 110.

Battery pack 300 may be any suitable containment unit that includes a battery. In some examples, there may be a plurality of batteries disposed within battery pack 300. As illustrated, battery pack 300 may be disposed in housing 320. Battery pack 300 may supply power to electronics 302 and/or to any other sensor present within control unit 202. Battery pack may also supply power via an electrical feedthrough at a distal end to other adjacent tools.

Electronics 302 may provide instructions to and/or from any components within control unit 202. In examples, electronics 302 may include a processing unit, a network storage device, and/or any other suitable device. As illustrated, electronics 302 may be disposed in housing 320. The components within electronics 302 may vary in size, shape, performance, functionality, and price. Electronics 302 may include random access memory (RAM), one or more processing resources such as a central processing unit (CPU) or hardware or software control logic, ROM, and/or other types of nonvolatile memory. For example, electronics 302 may include memory 322 and processor 324. Electronics 302 may also include one or more buses operable to transmit communications between the various hardware components and any suitable wiring.

Telemetry module 304 may be able to communicate information from control unit 202 to information handling system 114 (e.g., referring to FIG. 1). In further examples, telemetry module 304 may be able to receive information from information handling system 114. As illustrated, telemetry module 304 may be disposed in housing 320. In examples, telemetry module 304 may employ any suitable type of communication means. Without limitation, telemetry module 304 may use communication means such as acoustics, electromagnetic waves, mud pulse telemetry, and/or combinations thereof. In examples, telemetry module 304 may communicate via slickline 110 by way of electrical signals.

Trundle wheel 306 may be used to measure depth in tubular 130. There may be a plurality of trundle wheels 306. Trundle wheel 306 may extend from housing 320 of control unit 202 and be in contact with tubular 130. Trundle wheel 306 may extend from housing 320 using any suitable mechanism including, but not limited, the use of suitable fasteners, threading, adhesives, welding and/or any combination thereof. Without limitation, suitable fasteners may include nuts and bolts, washers, screws, pins, sockets, rods and studs, hinges and/or any combination thereof. In examples, trundle wheel 306 may be mounted via bearings and/or bushings. Trundle wheel 306 may include magnets, hall-effect sensors, a resolver assembly, and/or combinations thereof to count the number of wheel rotations as control unit 202 travels along tubular 130 (e.g., referring to FIG. 1). Depth information gathered from use of trundle wheel 306 may enable more accurate positioning of perforation gun 204 in tubular 130. Trundle wheel 306 may additionally include a spring-loaded caliper (not illustrated) that presses trundle wheel 306 against the inside of tubular 130. In examples, the spring-loaded caliper may be coupled to trundle wheel 306 via a caliper arm (not illustrated) in order to take measurements. In certain examples, trundle wheel 306 may include a passive or active braking system (not illustrated). The braking system may include coils and/or magnets to apply a torque to trundle wheel 306 to prevent trundle wheel 306 from rotating.

As control unit 202 is moving throughout tubular 130 (e.g., referring to FIG. 1), accelerometer 308 may be measuring the acceleration of control unit 202. Without limitations, accelerometer 308 may be a single axis or a multi-axis accelerometer. Without limitations, accelerometer 308 may be piezoelectric and/or a micro electro-mechanical system. As illustrated, accelerometer 308 may be disposed in housing 320. In examples, control unit 202 may instruct downhole perforating system 102 (e.g., referring to FIG. 1) to actuate based on measurements gathered by accelerometer 308.

Casing collar locator 310 may additionally be operating as control unit 202 displaces throughout tubular 130 (e.g., referring to FIG. 1). Casing collar locator 310 may serve as a tool for discerning the depth of control unit 202. Without limitations, casing collar locator 310 may include coils, magnets, an amplifier, and/or combinations thereof. Casing collar locator 310 may be disposed on, or in, housing 320. As control unit 202 travels past the location of a collar, there may be a change in the surrounding magnetic field. The change in the surrounding magnetic field may induce a current. The amplifier may amplify the current, and that signal may be sent to surface 115 (e.g., referring to FIG. 1) for processing. In alternate examples, a magnetic field may be induced by driving a current through a first coil (not illustrated), and a second coil (not illustrated) may record the interactions of the produced magnetic field with potential casing collars, perforations, and/or casing anomalies. In other examples, the signal may be processed within control unit 202 through electronics 302. By knowing the location of casing collars on tubular 130, the firing of perforation gun 204 through a casing collar may be prevented. Data provided by accelerometer 308 and trundle wheel 306 may also be critical in selecting perforation depth so as to avoid casing collars.

In examples, temperature gauge 312 may measure the surrounding temperature of control unit 202 and pressure gauge 316 may measure the well pressure around control unit 202. Temperature gauge 312 and pressure gauge 316 may be positioned on, or in, housing 320. During operations, there may be a threshold temperature and/or pressure that would inhibit actuation of downhole perforating system 102 (e.g., referring to FIG. 1) at the surface. Without limitations, the threshold temperature may be about 200° F. (93° C.). Without limitations, the threshold pressure may be about 2000 psi (13790 kilopascals). In examples, temperature switch 314 may prevent power from being supplied to perforating guns 204 and/or setting tool 206, thus preventing premature detonation, if the temperature threshold is exceeded. Likewise, if the pressure threshold is exceed, pressure switch 318 may prevent power from being supplied to perforating guns 204 and/or setting tool 206.

Referring back now to FIG. 2, as downhole perforating system 102 displaces along tubular 130, the measurements collected by control unit 202 may dictate whether or not the subsequent perforating guns 204 and/or setting tool 206 will actuate. Inputs may include, for example, one or more of depth information from trundle wheel 306, collar information from casing collar locator 310, temperature information from temperature gauge 312, pressure information from pressure gauge 316, and acceleration information from accelerometer 308. Gamma ray information from a gamma ray logging tool (e.g., a gamma ray detector) may also be used as input as gamma ray information can be used to characterize the subterranean formation 128 (e.g., shown on FIG. 1). While not shown a gamma ray logging tool may also be included on control unit 202. Any other suitable formation evaluation tools may be included in downhole perforating system 102, such as, without limitations, acoustic monopole, dipole sonic, and/or nuclear magnetic resonance tooling. Prior to actuation of perforating guns 204, a setting tool 206 may be used to isolate the zone of interest to be perforated within tubular 130. In examples, setting tool 206 may be explosive and/or non-explosive. Without limitations, setting tool 206 may comprise a packer and/or a plug. Setting tool 206 may seal off a portion of wellbore 124 (e.g., referring to FIG. 1) that is producing hydrocarbons. In examples, the setting tool 206 may set a plug which may be detached from downhole perforating system 102. After the setting process is completed, downhole perforating system 102 may be pulled uphole. As downhole perforating system 102 displaces uphole, perforating guns 204 may be actuated to detonate and create perforations in tubular 130.

Safety can be a priority when handling and operating a downhole perforating system 102. For example, misfiring at the surface or at the wrong depth can be hazardous for personnel and also have a detrimental impact on the underground environment. Accordingly, control unit 202 may implement multiple safety criteria to ensure the perforating gun 204 is at the correct location and/or time to prevent, or reduce the potential, for firing at the surface and/or wrong depth. Suitable safety criteria may include, but are not limited to, temperature information from temperature gauge 312, pressure information from pressure gauge 316, depth information from trundle wheel 306, time information from a real time clock disposed in downhole perforating system 102 or in information handling system 114, and/or the perforating gun 204 has been properly identified by the control unit 202. In some examples, a time threshold may be implemented such that firing cannot be implemented until the time threshold has been exceeded. The timer may begin counting, for example, after the placement of the downhole perforating system 102 downhole. Alternatively, the timer may be programmed and started at surface 108 (i.e., referring to FIG. 1) prior to being run downhole. Once the safety criteria have determined that the perforating gun 204 is at the correct location and/or time, examples may include the control unit 202 initializing firing of the perforating gun 204.

While only a single perforating gun 204 is shown, there may be plurality of perforating guns 204 disposed on downhole perforating system 102. In examples, perforating guns 204 may be actuated by control unit 202 to detonate shaped charges in order to create openings within tubular 130. Without limitations, each perforating gun 204 may include a firing head, a handling subassembly, a gun subassembly, and/or combinations thereof. Additionally, each perforating gun 204 may include gun electronics, such as a selective firing switch (not illustrated) and an electronically activated detonator (not illustrated), such as a commercially available A140, A80, or Halliburton RED detonator. If perforating guns 204 comprise a selective firing switch, then the perforating guns 204 may further comprise a memory and processor. In examples, gun electronics may store, send, and/or receive information via wired and/or wireless connections throughout downhole perforating system 102.

As illustrated in FIG. 2, release tool 212 may be disposed in downhole perforating system 102. In examples, release tool 212 may be disposed between the plurality of perforating guns 204 and setting tool 206, between logging head 200 and control unit 202, or between control unit 202 and the plurality of perforating guns 204. Release tool 212 may release a portion of slickline 110 if downhole perforating system 102 gets stuck downhole. In examples, release tool 212 may connect an upper portion of slickline 110 to a lower portion of slickline 110 within downhole perforating system 102. Release tool 212 may release a portion of slickline 110 by command from surface 108. Release tool 212 may be pre-programmed to operate on a timed delay and/or in response to a stimulus (i.e., over-pull on slickline 110). In examples, release tool 212 may enable slickline 110 to be retrieved from downhole and allow for a fishing operation to be undertaken to retrieve any potential tooling that is stuck.

Figure 4:
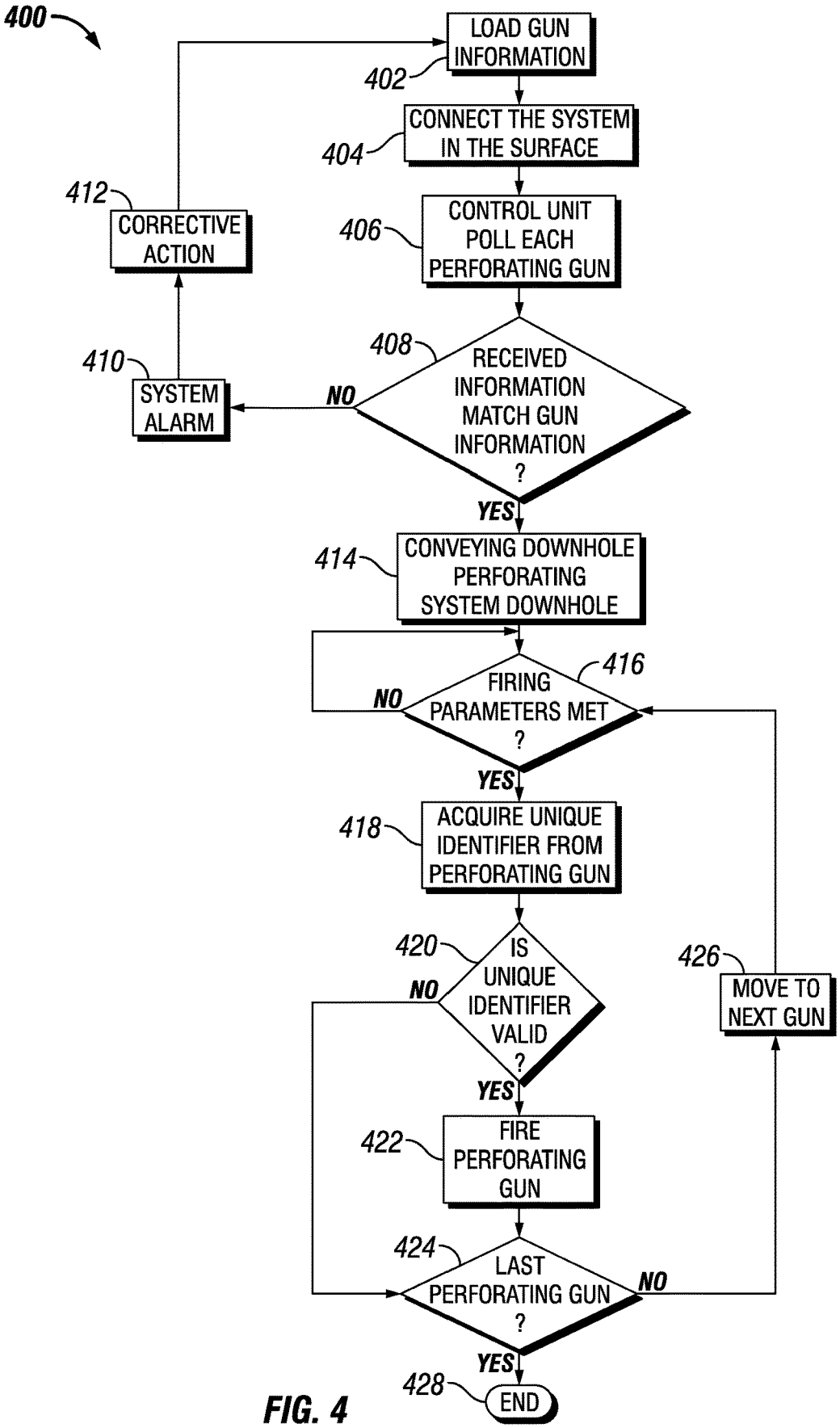
FIG. 4 is a flowchart illustrating an example workflow for a downhole perforating system.

FIG. 4 illustrates a flowchart 400 depicting a work flow for downhole perforating system 102 (e.g., referring to FIG. 1). Flowchart 400 may include multiple steps describing the proper operation of downhole perforating system 102. At step 402, an operator may load gun and mission profile information into control unit 202 (e.g. referring to FIG. 2). Without limitations, mission profile information may comprise information such as where to set a plug with setting tool 206 (i.e., referring to FIG. 2), where to actuate perforating guns 204 (i.e., referring to FIG. 2), delay times, depth, diameter of wellbore 124 (i.e., referring to FIG. 1), casing collars, and/or the like. By way of example, the gun and mission profile information may be loaded into memory 322 (e.g., referring to FIG. 3). Gun information may include suitable information concerning perforating guns 204 (e.g., referring to FIG. 2) and/or setting tool 206 (e.g., referring to FIG. 2). Without limitation, the gun and mission profile information may include an equipment list. The equipment list may include, for example, the number of perforating guns 204, a unique identifier for each of perforating guns 204 and/or setting tool 206, the pressure threshold, the temperature threshold, a time threshold, a target depth, and/or combinations thereof may be entered into control unit 202. The unique identifier may be any suitable criteria that can be used for identification of each of perforating guns 204 and/or setting tool 206. Suitable unique identifiers may include, but are not limited to, an encoding scheme and/or encryption key. The pressure threshold, temperature threshold, time threshold, and target depth may be individual for each of perforating guns 204 and setting tool 206 or may be a common criterion for the entire downhole perforating system. For example, each of perforating guns 204 may have a different pressure threshold, temperature threshold, time threshold, and/or target depth for actuation.

After the gun and mission profile information is loaded into control unit 202, a step 404 may occur. In step 404, the operator may connect the control unit 202 to the downhole perforating system, for example, connecting the control unit 202 to perforating guns 204 and setting tool 206. This connection may also occur prior to loading the gun and mission profile information. By way of example, the control unit 202 may be mechanically and/or electrically connected to downhole perforating system 102 at surface 115 (e.g., referring to FIG. 1). In a step 406, once control unit 202 is connected to downhole perforating system 102, control unit 202 may poll each perforating gun 204. In examples, control unit 202 may broadcast a signal asking to receive the unique identifier for each respective perforating gun 204 and/or setting tool 206. Each perforating gun 204 and setting tool 206 may be polled, for example, according to an equipment list from the gun and mission profile information loaded into memory 322 (e.g., referring to FIG. 3). The unique identifier may be stored, for example, on gun electronics for each perforating gun 204 and setting tool 206. Alternatively, control unit 202 may process the information received from perforating guns 204 and/or setting tool 206.

Step 408 may be a decision step to determine whether the received information matches the gun and mission profile information. For example, the information received from the perforating guns 204 and/or setting tool 206 is compared to the previously loaded gun and mission profile information. In some examples, a determination is made whether the received information for each of perforating guns 204 and setting tool 206 matches the unique identifier from the equipment list. In examples, if the gun and mission profile information entered into control unit 202 in step 402 matches the signals received from perforating guns 204 and/or setting tool 206, then downhole perforating system 102 may be disposed downhole at step 414. If the information does not match, a step 410 may follow.

Step 410 may include of starting a system alarm. In examples, the system alarm may include, but is not limited alert messages, flashing lights, noises, and/or the like. Step 410 may alert the operator that there is a mismatch between the perforating guns 204 and/or the setting tool 206 with the gun and mission profile information loaded into control unit 202. Without limitation, this may occur if one of the plurality of perforating guns 204 was not attached to downhole perforating system or one of the perforating guns 204 was not attached correctly.

At step 412, corrective action may be taken in response to the system alarm. For example, an operator may check the gun and mission profile information loaded into control unit 202 and/or check the perforation guns 204 and/or setting tool 206 attached to the control unit 202. A correction may then be made, for example, re-attaching one or more of perforating guns 204 or updating the gun and mission profile information. Step 402, step 404, step 406, and step 408 may be repeated until the information received via signals to control unit 202 matches the gun and mission profile information loaded into control unit 202.

Step 414 may include of conveying downhole perforating system 102 downhole into wellbore 124 (e.g., referring to FIG. 1). As downhole perforating system 102 is being conveyed downhole, control unit 202 may be measuring any suitable well parameter. Without limitations, the well parameter may be depth within wellbore 124, location of a casing collar, pressure, temperature, gamma radiation, acceleration of downhole perforating system 102, inner diameter of tubular 130 (e.g., referring to FIG. 1), formation resistivity, magnetic resonance of a formation, or acoustic measurements of the formation, and/or combinations thereof. Once firing parameters are met by analyzing the measurements of the well parameter, a step 416 may occur.

Step 416 may be a decision step to determine whether certain firing parameters have been met. Decision step 416 may be made downhole in control unit 202 or at surface 108 (i.e., referring to FIG. 1) in information handling system 114 (i.e., referring to FIG. 1) after information has been transmitted via slickline 110 (i.e., referring to FIG. 1). In examples, control unit 202 may verify that all firing parameters for a specific perforating gun 204 and/or setting tool 206 have been met. The firing parameters may coincide with measurements of the well parameters. If the firing parameters have not been met, then downhole perforating system 102 may continue to travel downhole or uphole. If the firing parameters have been met, then a step 418 may be implemented.

Step 418 may include acquisition of unique identifier from a perforating gun 204 or setting tool 206. The unique identifier may be acquired by the control unit 202. Control unit 202 may send the unique identifier to information handling system 114 (e.g., referring to FIG. 1) via slickline 110 (e.g., referring to FIG. 1). Alternatively, control unit 202 may process the unique identifier through electronics 302.

Step 420 may be a decision step to determine whether the unique identifier is valid. It may be verified whether or not the unique identifier of the perforating gun 204 or setting tool 206 is valid by comparison of the unique identifier to the gun information. This may occur at surface 115 (e.g., referring to FIG. 1) with information handling system 114 or downhole with control unit 202, for example, by comparison to the gun information previously loaded onto control unit 202. If the unique identifier is valid, a step 422 may occur. If the unique identifier is not valid, a step 424 may occur.

Step 422 may include of firing a perforation gun 204 (and/or setting tool 206). Firing the perforating gun 204 and/or setting tool 206 may include issuing an actuation signal to the perforating gun 204 or setting tool 206 that sent the respective unique identifier. In examples, the actuation signal may be originated from information handling system 114 and/or control unit 202. If the actuation signal is being sent to setting tool 206, the actuation signal may instruct setting tool 206 to actuate to seal off a portion of wellbore 124 (e.g., referring to FIG. 1). If the actuation signal is being sent to perforating gun 204, the actuation signal may instruct perforating gun 204 to detonate and create an opening within tubular 130 (e.g., referring to FIG. 1). If the actuation signal is being sent to release tool 212, the actuation signal may instruct the release tool to release a portion of slickline 110 if downhole perforating system 102 should get stuck in tubular 130. Step 424 may be a decision step to determine whether a certain criterion has been met. Step 424 may determine whether the last perforating gun 204 (or setting tool 206) was actuated in step 422. If the perforating gun 204 or setting tool 206 that was actuated in step 422 is the last tool in the sequence, then a concluding step 428 may end the work flow of flowchart 400. If the perforating gun 204 or setting tool 206 that was actuated in step 422 is not the last tool in the sequence, then a step 426 may occur.

Step 426 may be an intermediary step that instructs control unit 202 to continue on with the following perforating gun 204. Step 416, step 418, step 420, step 422, and step 424 may repeat until the last perforating gun 204 is actuated. Concluding step 428 may end the work flow of flowchart 400. In examples, downhole perforating system 102 may be removed from wellbore 124 after concluding step 428.

The systems and methods may include any of the various features of the systems and methods disclosed herein, including one or more of the following statements.

Statement 1. A well system, comprising: a downhole perforating system comprising: at least one perforating gun; a setting tool; and a control unit coupled to the at least one perforating gun and the setting tool in a tool string for conveyance downhole, wherein the control unit comprises a battery pack, electronics, at least one sensor, wherein the electronics are operable to send one or more actuation signals to the at least one perforating gun and the setting tool.

Statement 2. The well system of statement 1, further comprising a slickline, wherein the downhole perforating system is disposed on the slickline.

Statement 3. The well system of statement 2, wherein the slickline comprises a digital slickline operable to transmit electrical signals to the downhole perforating system.

Statement 4. The well system of statement 2, further comprising a logging head on the tool string, wherein the logging head couples the downhole perforating system to the slickline, wherein the slickline attaches to a first end of the logging head, wherein the control unit is disposed at a second end of the logging head.

Statement 5. The well system of any one of the previous statements, wherein the at least one perforating gun comprises a plurality of perforating guns.

Statement 6. The well system of statement 5, wherein the plurality of perforating guns are disposed between the control unit and the setting tool.

Statement 7. The well system of any one of the previous statements, wherein the setting tool comprises a packer or a plug.

Statement 8. The well system of any one of the previous statements, wherein the control unit further comprises a telemetry module, wherein the telemetry module transmits electrical signals through the slickline.

Statement 9. The well system of any one of the previous statements, wherein the battery pack comprises a battery, wherein the battery pack supplies power to the electronics, wherein the electronics comprise a memory and a processor, wherein gun information is loaded onto the memory, wherein the gun information comprises a unique identifier for each of the at least one perforating gun and criteria for activation of each of the at least on perforating gun.

Statement 10. The well system of any one of the previous statements, wherein the control unit further comprises housing and a trundle wheel that extends from the housing, and a casing collar locator coupled to the housing, wherein the at least one sensor comprises an accelerometer, a pressure gauge, and a temperature gauge.

Statement 11. The well system of statement 10, wherein the control unit further comprises a pressure switch prevents power from being supplied to the at least one perforating gun and the setting tool until a threshold pressure has been reached.

Statement 12. The well system of statement 10, wherein the control unit further comprises a temperature switch prevents power from being supplied to the at least one perforating gun and the setting tool until a threshold temperature has been reached.

Statement 13. A method of perforating a casing string, comprising: disposing a downhole perforating system downhole, wherein the downhole perforating system is disposed on a slickline, wherein the downhole perforating system comprises at least one perforating gun, a setting tool, and a control unit comprising at least one sensor; measuring a well parameter with the control unit; and sending an actuation signal to the at least one perforating gun in response to at least the measured well parameter to create an opening in the casing string.

Statement 14. The method of statement 13, further comprising loading gun information into the control unit, connecting the control unit to the downhole perforating system and then polling the at least one perforating gun and/or the setting tool for a unique identifier such that the control unit receives the unique identifier, and determining whether the unique identifier matches the gun information.

Statement 15. The method of statement 14, further comprising of starting a system alarm, if the unique identifier does not match the gun information.

Statement 16. The method of any one of statements 13 to 15, wherein the measured well parameter is one or more of depth, location of a casing collar, pressure, temperature, gamma radiation, acceleration of the downhole perforating system, or formation characteristics derived from one or more of acoustic measurements, resistivity measurements, magnetic resonance measurements, or nuclear measurements.

Statement 17. The method of any one of statements 13 to 16, further comprising of releasing a portion of the slickline from the downhole perforating system with a release tool.

Statement 18. The method of any one of statements 13 to 17, further comprising actuating the setting tool to create a seal within the casing string.

Statement 19. The method of any one of statements 13 to 18, wherein the control unit further comprises housing and a trundle wheel that extends from the housing, and a casing collar locator coupled to the housing, wherein the at least one sensor comprises an accelerometer, a pressure gauge, a temperature gauge, and a load cell.

Statement 20. The method of any one of statements 13 to 19, wherein sending power to the at least one perforating gun if a temperature threshold and/or a pressure threshold have been reached.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A well system, comprising:

an information handling system positioned at a surface of a wellbore;

a digital slickline comprising a single mechanical strand and an insulator around the single mechanical strand, the digital slickline configured to be lowered into the wellbore, and wherein the digital slickline is operable to transmit electrical signals;

a downhole perforating system disposed on the digital slickline, comprising:

at least one perforating gun; and a control unit coupled to the at least one perforating gun in a tool string for conveyance downhole, wherein the control unit comprises a battery pack, electronics, at least one sensor, and a telemetry module, wherein the telemetry module is configured to transmit measured well parameters via electrical signals through the digital slickline to the information handling system, wherein the information handling system is configured to acquire a unique identifier corresponding to the at least one perforating gun from the telemetry module in response to determining that firing parameters are met based at least in part on the measured well parameters, wherein the telemetry module is configured to transmit the unique identifier to the information handling system via electrical signals through the digital slickline, the information handling system configured to output an actuation signal to the telemetry module via electrical signals through the digital slickline in response to determining that the unique identifier is valid, and wherein the at least one perforating gun is configured to fire in response to receiving the actuation signal from the information handling system via the digital slickline and the control unit.

2. The well system of claim 1, further comprising a casing string positioned within the wellbore, wherein the digital slickline, the wellbore fluid, and the casing string form an electric circuit between the control unit and the information handling system.

3. The well system of claim 2, wherein the casing string is configured to conduct a return current of the electrical signals transmitted via the digital slickline.

4. The well system of claim 2, further comprising a logging head on the tool string, wherein the logging head couples the downhole perforating system to the digital slickline, wherein the digital slickline attaches to a first end of the logging head, wherein the control unit is disposed at a second end of the logging head.

5. The well system of claim 1, wherein the at least one perforating gun comprises a plurality of perforating guns.

6. The well system of claim 5, wherein the downhole perforating system further comprises a setting tool, and wherein the plurality of perforating guns are disposed between the control unit and the setting tool.

7. The well system of claim 6, wherein the setting tool comprises a packer or a plug.

8. The well system of claim 1, wherein the battery pack comprises a battery, wherein the battery pack supplies power to the electronics and to the at least one perforating gun, wherein the electronics comprise a memory and a processor, wherein gun information is loaded onto the memory, wherein the gun information comprises a unique identifier for each of the at least one perforating gun and criteria for activation of each of the at least on perforating gun.

9. The well system of claim 1, wherein the control unit further comprises a housing and a trundle wheel that extends from the housing, and a casing collar locator coupled to the housing, wherein the at least one sensor comprises a plurality of sensors, the plurality of sensors comprising an accelerometer, a pressure gauge, and a temperature gauge.

10. The well system of claim 9, wherein the control unit further comprises a pressure switch that prevents power from being supplied to the at least one perforating gun until a threshold pressure has been reached.

11. The well system of claim 9, wherein the control unit further comprises a temperature switch that prevents power from being supplied to the at least one perforating gun until a threshold temperature has been reached.

12. A method of perforating a casing string, comprising:

disposing a downhole perforating system downhole in a wellbore, wherein the downhole perforating system is disposed on a digital slickline, wherein the downhole perforating system comprises at least one perforating gun and a control unit comprising at least one sensor and a telemetry module, wherein the telemetry module is configured to transmit electrical signals to an information handling system positioned at a surface of the wellbore via the digital slickline, and wherein the telemetry module is configured to receive electrical signals from the information handling system via the digital slickline;

measuring a well parameter with the at least one sensor;

transmitting the measured well parameter with the telemetry module to the information handling system via the digital slickline, wherein the information handling system is configured to determine that firing parameters have been met based at least in part on the measured well parameter;

transmitting a unique identifier corresponding to the at least one perforating gun to the information handling system in response to the information handling system determining that firing parameters have been met, wherein the telemetry module is configured to transmit the unique identifier to the information handling system via the digital slickline;

receiving an actuation signal, with the telemetry module, to fire the at least one perforating gun in response to the information handling system determining that the unique identifier is valid, wherein the actuation signal is sent from the information handling system via the digital slickline; and firing the at least one perforating gun in response to receiving the actuation signal.

13. The method of claim 12, further comprising loading gun information into the control unit, connecting the control unit to the downhole perforating system and then polling the at least one perforating gun for a unique identifier such that the control unit receives the unique identifier, and determining whether the unique identifier matches the gun information.

14. The method of claim 13, further comprising of starting a system alarm in response to the unique identifier not matching the gun information.

15. The method of claim 12, wherein the measured well parameter comprises a depth within the wellbore, a location of a casing collar, a pressure within the wellbore, a temperature within the wellbore, gamma radiation within the wellbore, an acceleration of the downhole perforating system, acoustic measurements of a formation, resistivity measurements of the formation, magnetic resonance measurements of the formation, nuclear measurements of the formation, or some combination thereof.

16. The method of claim 12, further comprising of releasing a portion of the slickline from the downhole perforating system with a release tool.

17. The method of claim 12, further comprising actuating a setting tool of the downhole perforating system to create a seal within the casing string.

18. The method of claim 12, wherein the control unit further comprises a housing and a trundle wheel that extends from the housing, and a casing collar locator coupled to the housing, wherein the at least one sensor comprises a plurality of sensors, the plurality of sensors comprising an accelerometer, a pressure gauge, a temperature gauge, and a load cell.

19. The method of claim 12, further comprising connecting electrical power to the at least one perforating gun if a temperature threshold and/or a pressure threshold have been reached.

* * * * *